United States Patent [19]

Frazer

[11] Patent Number: 4,540,345

[45] Date of Patent: Sep. 10, 1985

[54] PRECOMPRESSION VALVE FOR HYDRAULIC PUMPS

[75] Inventor: Hugh I. Frazer, Lower Portland, Australia

[73] Assignee: Ifield Engineering Pty. Limited, Dural, Australia

[21] Appl. No.: 498,453

[22] Filed: May 26, 1983

[30] Foreign Application Priority Data

Jun. 3, 1982 [AU] Australia ..... PF4279

[51] Int. Cl.[3] ..... F04B 1/12; F01B 13/04

[52] U.S. Cl. ..... 417/269; 91/6.5; 91/499

[58] Field of Search ..... 91/6.5, 487, 488, 499, 91/505, 506; 417/269, 565

[56] References Cited

U.S. PATENT DOCUMENTS

| | | | |
|---|---|---|---|
| 2,642,809 | 6/1953 | Born et al. | 91/6.5 |
| 2,913,168 | 11/1959 | Heidorn | 417/269 |
| 2,925,040 | 2/1960 | Rose | 417/270 |
| 3,179,060 | 4/1965 | Lehrer | 91/6.5 |
| 3,199,461 | 8/1965 | Wolf | 91/6.5 |
| 3,200,761 | 8/1965 | Firth et al. | 91/6.5 |
| 3,366,314 | 1/1968 | Schröder | 417/68 |
| 3,382,813 | 5/1968 | Schauer | 91/474 |
| 3,699,845 | 10/1972 | Ifield | 91/6.5 |
| 3,956,969 | 5/1976 | Hein | 91/6.5 |
| 3,957,399 | 5/1976 | Siczek | 417/388 X |
| 4,351,227 | 9/1982 | Copp, Jr. et al. | 417/269 X |

FOREIGN PATENT DOCUMENTS

| | | | |
|---|---|---|---|
| 639046 | 3/1928 | France | 417/565 |
| 32080 | 2/1982 | Japan | 417/269 |
| 845104 | 8/1960 | United Kingdom | 417/565 |
| 2064673 | 6/1981 | United Kingdom | 91/499 |

*Primary Examiner*—William L. Freeh
*Assistant Examiner*—Paul F. Neils
*Attorney, Agent, or Firm*—Edmund F. Bard

[57] ABSTRACT

A hydraulic pump for liquids of the type comprising a body, a cylinder rotor surrounded by and mounted in an external support, the body having an inlet port and an outlet port for the liquid to be pumped and the rotor carrying a plurality of equiangularly spaced cylinders which are disposed parallel to or radially extending from the rotor axis, pistons in the cylinders being caused to reciprocate as the rotor is rotating, by cam means such as a surface inclined to the rotor axis or by inclining the rotor axis itself in order to pump liquid. As the rotor rotates the cylinders are moved sequentially past the inlet port as the liquid is drawn into the cylinders and sequentially past the outlet port as the liquid is forced out of the cylinders by the actions of the pistons. As each cylinder passes from the inlet port to the outlet port a precompression zone is provided in which there is a hole communicating with the high pressure outlet port, the hole being closed by a valve which opens when the pressure in the cylinder reaches the pressure in the outlet port. The invention is characterized by the provision of a flat spring valve to control the opening and closing of the hole, the flat spring valve being preferably of a stiffness such that it substantially closes under its own resilience in the absence of a pressure differential across it and consists preferably of a central portion from which two or three arms extend radially, the arms being clamped at their extremities between faces and parts of the hydraulic pump.

6 Claims, 5 Drawing Figures

Figure 1:
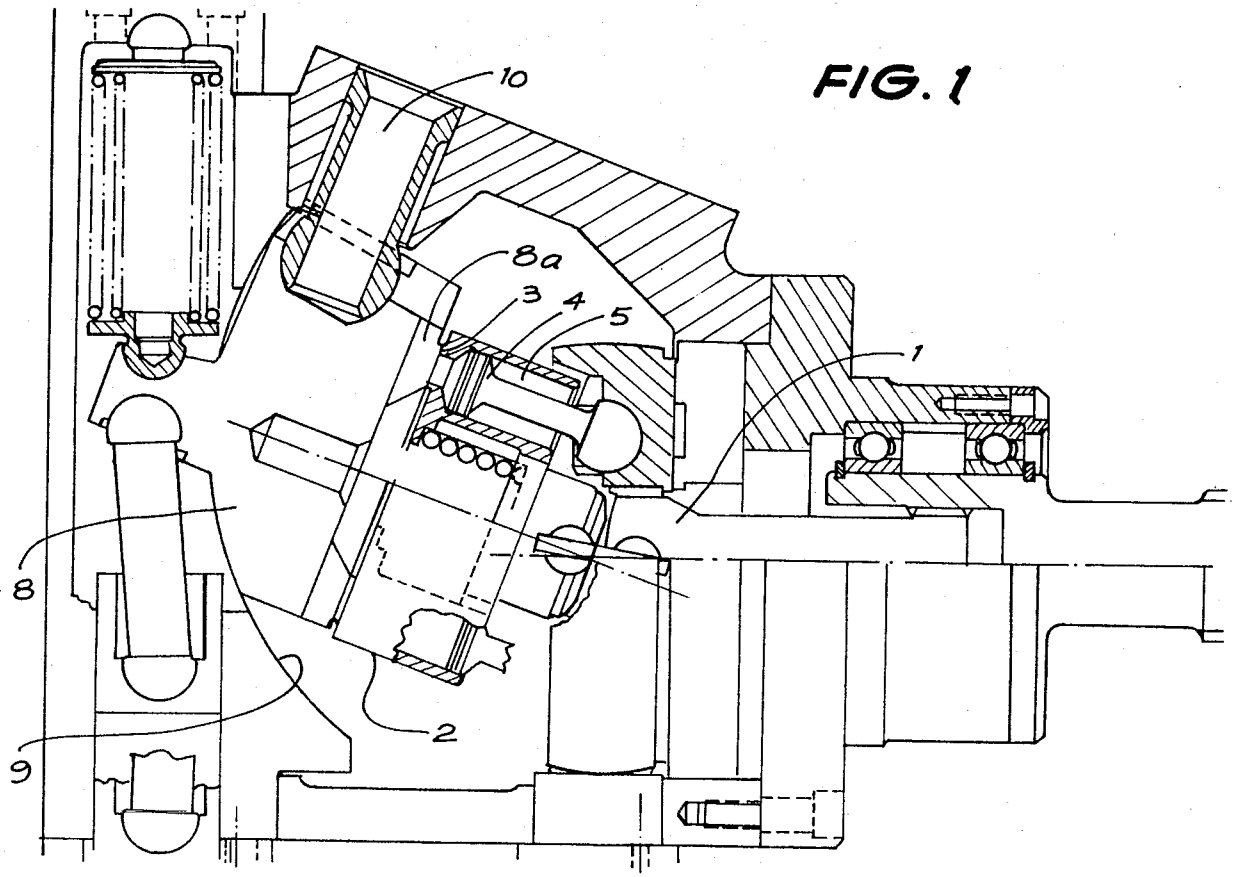

FIG. 3
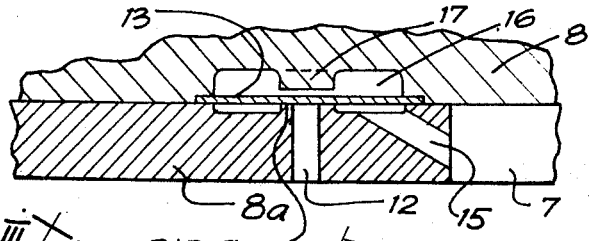
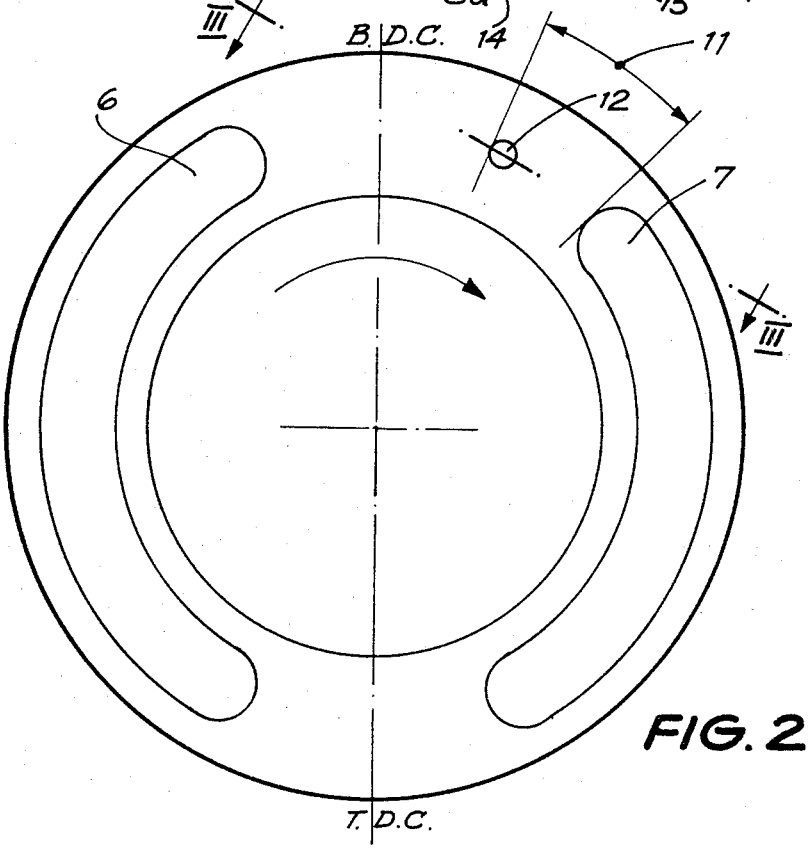
FIG. 2
FIG. 4
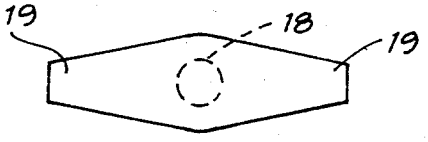
FIG. 5
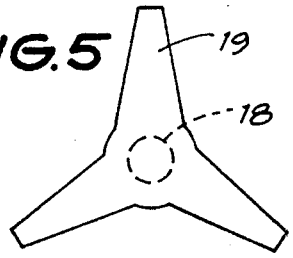

PRECOMPRESSION VALVE FOR HYDRAULIC PUMPS

This invention relates to hydraulic pumps for liquids of the type that comprise a body, a cylinder rotor surrounded by and mounted in an external support, the body having an inlet port and an outlet port for the liquid to be pumped and the rotor carrying a plurality of equiangularly spaced cylinders which are disposed parallel to or radially extending from the rotor axis, pistons in the cylinders being caused to reciprocate, as the rotor is rotated, by cam means such as a surface inclined to the rotor axis or by inclining the rotor axis itself, in order to pump liquid. As the rotor rotates the cylinders are moved sequentially past the inlet port as liquid is drawn into the cylinders and sequentially past the outlet port as the liquid is forced out of the cylinders by the actions of the pistons.

Such piston pumps are prone to noisy operation. One cause of this noise is the sudden inrush of high pressure liquid from a high pressure outlet port into a cylinder that has just been rotated from a pressure inlet port, the inrush occurring because of the slight compressibility of the fluid. It is common practice to provide means to open the cylinder to the high pressure outlet relatively slowly and, although a significant improvement can be achieved in this manner, the resulting performance is not satisfactory for some applications. It is also common practice to provide a precompression zone so that the piston in each cylinder moves to precompress the fluid before the cylinder is opened to the high pressure outlet. The use of a precompression zone in conjunction with slow opening means gives good results over a limited range of pump displacements, speeds and pressures.

In order to provide acceptable performance for some applications requiring a wide range of pump displacements, speeds and pressures it is necessary to provide as generous a precompression zone as possible and an automatic valve that opens to the high pressure outlet port to prevent over precompression occurring in the cylinder. Without such a precompression valve, the cylinder pressure could rise to very high values with resultant noise and shock loadings.

Known designs of precompression valves are not generally successful being either too heavy to operate at the high frequencies required or insufficiently robust to withstand the constant opening and closing under fluctuating low to high pressures.

There have been many attempts to provide a satisfactory pre-compression valve. Examples of previous approaches to the problem are shown in the following patent specifications:

1. U.S. Pat. No. 3,382,813 May 14, 1968 Schauer, shows the use of relatively heavy poppet valves and light springs. Due to their weight the poppet valves would not open fully at higher pump speeds and due to the combination of their weight with the light springs they would be violently and destructively, in the present applicants experience, closed by full delivery pressure.

2. U.S. Pat. No. 3,199,461 Aug. 10, 1965 Wolf, teaches the use of sliding plungers that have the appearance of flat valves but do not provide an opening into the outlet port.

3. U.S. Pat. No. 3,179,060 Apr. 20, 1965 Lehrer, shows ball and spring valves but teaches that "any one way valve well known in the art can be used". The present applicants experience shows that ball and spring valves, although cheap and easy to make, are too heavy for higher pump speeds and are invariably closed violently by the full system pressure, as it is impractical to provide springs strong enough and contradicts the view that any one way valve could be used successfully.

4. British Pat. No. 684,551 Dec. 17, 1952 Ludw. Von Roll'schen Eisenwerke AG teaches the use of "a very light valve" which agrees with the applicants experience. It is to be noted that the only springs disclosed are coil springs and there is no disclosure of the desirability of using a strong return spring. In the applicants experience valves of this specification would be destroyed by violent closing and higher pump speeds.

5. U.S. Pat. No. 2,642,809 June 23, 1953 Born also teaches the use of a coil spring applied to a "spring pressed ball check valve". The specification shows that the application of outlet pressure to the ball assists the spring in holding the ball in a closed position. It is said that on this account a relatively light spring may be employed which will offer a very slight resistance to opening movement of the valve. While "slight resistance" is desirable the applicants experience indicates that the use of a relatively light coil spring would be unsuccessful due to destruction of the valve by violent closure.

6. U.S. Pat. No. 2,529,309 Nov. 7, 1950 Purcell shows another example of the use of a ball and spring valve.

7. British Pat. No. 506,684 teaches the use of spring loaded ball and poppet valves which would have the disadvantages referred to above.

8. British Pat. No. 442,450 Feb. 10, 1936 Kopler discloses the use of a disc valve and coil spring which would also be subject to the disadvantages referred to.

Despite the numerous attempts that have been made to solve the problem with which the present application is concerned, to the best of the applicants knowledge and belief there is no precompression valve commercially offered in a hydraulic pump.

Apart from the patents referred to above which are directly related to the solution proposed by the present invention there are other patents providing a precompression check valve for each cylinder; while this arrangement allows much more time for the valve to close it is very complex and costly to produce. U.S. Pat. Nos. 2,781,775, 2,661,695 and 2,553,655 show such arrangements.

A further group of patents show complex valve means to avoid the need for using a fast acting precompression check valve. Examples of such patents are British Pat. No. 1,589,601, U.S. Pat. No. 3,956,969 and many others. These however all disclose relatively complex and expensive structures.

The object of the present invention is to provide a precompression valve capable of withstanding higher fluctuating pressure at higher frequencies than known designs thus providing for piston pump operation at reduced noise levels to make such a pump suitable for a wider range of applications.

The object of the invention is achieved by the use of a flat spring valve, that is to say, a valve made from flat springy sheet material, typically steel. The valve itself is not necessarily completely flat but may be slightly dished or curved. It has been found that such a valve can be designed to close sufficiently quickly after the passage of a cylinder that by the time the succeeding cylinder is in communication with the precompression valve it will be substantially closed. If this does not occur the valve while still open is subjected suddenly to a substantial closing pressure from the outlet port which will cause it to close violently with a consequent possibility of damage.

The present invention consists in a hydraulic pump for liquids comprising a body, a cylinder rotor surrounded by and mounted in an external support, the body having a face in which are an inlet port and an outlet port for the liquid to be pumped, the rotor carrying a plurality of equiangularly spaced cylinders which are disposed parallel to or radially extending from the rotor axis, pistons in the cylinders being caused to reciprocate as the rotor is rotated by cam means, the cylinders being moved sequentially over said face past the inlet port as liquid is drawn into the cylinder and sequentially past the outlet port as the liquid is forced out of the outlet port by the actions of the pistons, there being in said face between the inlet port and the outlet port a precompression zone past which the cylinders move in passing from the inlet port to the outlet port, there being in said zone an opening communicating with the outlet port characterised in that such communication is normally closed by a flat spring valve, the valve being arranged to open on the liquid pressure in a cylinder exceeding the liquid pressure at the outlet port.

In a preferred form of the invention the precompression valve consists of a flat spring valve having a central portion with two or more integral spring fingers, that is located over a flat surface in which an opening in the form of a hole is formed connecting the cylinder about to open, to the high pressure outlet port. The space surrounding the valve is connected to the high pressure outlet. The valve is formed so that its own resilience tends to hold it over the hole thus forming a seal to prevent high pressure fluid entering the cylinder. As the piston compresses the fluid in the cylinder, the pressure increases until it equals the high pressure in the outlet port at which time the valve is automatically opened to allow fluid out of the cylinder. The cylinder shortly thereafter is opened to the high pressure outlet by normal porting means so that equal pressure occurs across the valve allowing it to close, or at least partially close, under its own resilience, before the hole is connected to the next cylinder, still at low pressure, thus causing the valve to be forcefully clamped shut by the downstream pressure clamping it over the hole in sealing fashion.

The inherent lightness and resilient stiffness of the flat spring valve according to the invention permits its successful application over a wide range of duties.

The invention is described as applied to piston pumps having pistons disposed parallel to the rotor axis but it can be equally applied to hydraulic pumps in which the cylinders extend radially from the pump axis.

Preferred embodiments of the invention are hereinafter described by way of example with reference to the accompanying drawings in which:

FIG. 1 shows a variable displacement piston pump of a kind to which the invention is applicable, FIG. 2 shows a view of the porting face of the pump, FIG. 3 shows a scrap section across the porting face of the pump, and FIGS. 4 and 5 show plan views of the flat spring valves according to the invention.

Referring to FIG. 1, a variable displacement piston pump has a rotating shaft assembly 1 which drives a cylinder rotor 2 running against an adjustably inclined face 3 causing a number of pistons 4 to reciprocate in cylinders 5 causing liquid to pass in and out of ports (6 and 7 in FIG. 2) formed in face 3. Movement of the port block 8 along radial track 9 changes the angle of inclination of face 3 thus changing the piston stroke and the pump delivery. The ports 6 and 7 are connected to port tubes 10 to permit the liquid to pass into and out of the piston pump. The port block is shown constructed in two parts 8 and 8*a*.

Referring to FIG. 2, when the rotor rotates in a clockwise direction the cylinders are consecutively and continuously opened to the low pressure inlet port 6 as the pistons retract drawing liquid into the cylinders and then they connect to the high pressure outlet port 7 as the pistons return, delivering liquid out of the cylinders. A precompression zone 11 is provided to permit the piston to precompress the liquid before the cylinder opens to port 7. A hole 12 communicates from this zone to the precompression valve 13 shown in FIG. 3. The flat spring valve 13 preferably takes one of the forms illustrated in FIGS. 4 and 5. In either case the extremities of the arms 19 are clamped between the parts 8 and 8*a* of the port block and the central port 18 of the valve seats on a sealing face 14 formed around the hole 12. The valve 13 lies in a chamber 16 connected by the passage 15 to the outlet port 7. Movement of the valve 13 is limited by the boss 17 thus ensuring fast closing of the valve and preventing its being over stressed. When the cylinder pressure reaches the delivery port 7, pressure liquid passes down the hole 12, forces the valve away from sealing face 14 and passes through passage 15 from chamber 16 to the port 7.

Further rotation of the rotor opens the cylinder directly to the high pressure port 7 allowing equal pressure on both sides of the valve 13 so that it may close under its own resilience. With further rotation of the rotor, the next cylinder passes over the hole and the cycle repeats.

FIGS. 4 and 5 show plan views of preferred embodiments of the flat spring valve 13 consisting of a central sealing part 18 and spring fingers 19. The valve may be made flat or curved to provide a positive bias against the sealing face. The flat spring valve is made typically from spring steel and is of a stiffness such that it substantially closes when there is no pressure differential across it, that is to say before pressure from liquid in the high pressure port acts to close it.

Springs according to FIGS. 4 and 5 are made from a material suitable for the particular application. Spring steel is suited to many applications but materials such as stainless steel or beryllium copper can be used where appropriate.

Valves made from bright spring steel in accordance with FIG. 4 having a length of 22 mm, a width of 8 mm and a thickness of 0.6 mm, have been tested extensively by the applicants and during many hours of running in a water high based fluid pump for use in coal mines and in a hydrostatic transmission for motor vehicles the valve has functioned satisfactorily over a wide range of conditions with no failures being observed. In contrast experimental work with spring loaded ball valves has given rise to failures under operating conditions.

A flat spring valve in the form of a reed valve that is a flat spring valve fastened at one end, may be used but this is considered less desirable than the form of valve illustrated in FIGS. 4 and 5 as in such a valve the highest stress concentration, due to the fastening means, is at the point of highest bending stress thus giving rise to the possibility of failure. Valves constructed according to FIGS. 4 and 5 can be made lighter and thus will be faster acting than a reed valve.

I claim:

1. A hydraulic pump for liquids comprising a body, a cylinder rotor surrounded by and mounted in an external support, the body having a face in which are an inlet port and an outlet port for the liquid to be pumped, the rotor carrying a plurality of equiangularly spaced cylinders, pistons in the cylinders being caused to reciprocate as the rotor is rotated by cam means, the cylinders being moved sequentially over said face past the inlet port as liquid is drawn into the cylinder and sequentially past the outlet port as the liquid is forced out of the outlet face by the action of the pistons, there being in said face between the inlet port and the outlet port a precompression zone past which the cylinders move in passing from the inlet port to the outlet port, there being in said zone an opening communicating with the outlet port characterized in that such communication is normally closed by a flat spring valve, said flat spring valve being retained by said body, the flat spring valve consisting of a central portion from which at least two arms extend radially, the valve being arranged to open on the liquid pressure in a cylinder exceeding the liquid pressure at the outlet port.

2. A hydraulic pump as claimed in claim 1 wherein movement of the flat spring valve is limited by means of an abutment arranged adjacent thereto.

3. A hydraulic pump for liquids comprising a body, a cylinder rotor surrounded by and mounted in an external support, the body having a face in which are an inlet port and an outlet port for the liquid to be pumped, the rotor carrying a plurality of equiangularly spaced cylinders, pistons in the cylinders being caused to reciprocate as the rotor is rotated by cam means, the cylinders being moved sequentially over said face past the inlet port as liquid is drawn into the cylinder and sequentially past the outlet port as the liquid is forced out of the outlet face by the actions of the pistons, there being in said face between the inlet port and the outlet port a precompression zone past which the cylinders move in passing from the inlet port to the outlet port, there being in said zone an opening communicating with the outlet port characterized in that such communication is normally closed by a flat spring valve, the valve being arranged to open on the liquid pressure in a cylinder exceeding the liquid pressure at the outlet port, the flat spring valve being held by being clamped between faces of parts of the hydraulic pump, and wherein the flat spring valve consists of a central portion from which at least two arms extend radially.

4. A hydraulic pump as claimed in claim 3 wherein movement of the flat spring valve is limited by means of an abutment arranged adjacent thereto.

5. A hydraulic pump for liquids comprising a body, a cylinder rotor surrounded by and mounted in an external support, the body having a face in which are an inlet port and an outlet port for the liquid to be pumped, the rotor carrying a plurality of equiangularly spaced cylinders, pistons in the cylinders being caused to reciprocate as the rotor is rotated by cam means, the cylinders being moved sequentially over said face past the inlet port as liquid is drawn into the cylinder and sequentially past the outlet port as the liquid is forced out of the outlet face by the actions of the pistons, there being in said face between the inlet port and the outlet port a precompression zone past which the cylinders move in passing from the inlet port to the outlet port, there being in said zone an opening communicating with the outlet port characterized in that such communication is normally closed by a flat spring valve, the valve being arranged to open on the liquid pressure in a cylinder exceeding the liquid pressure at the outlet port, the flat spring valve being of a stiffness such that it substantially closes under its own resilience in the absence of a pressure differential across it after the passage of a cylinder past said opening and before the succeeding cylinder is in communication with the opening, the flat spring valve being held by being clamped between faces of parts of the hydraulic pump, and wherein the flat spring valve consists of a central portion from which at least two arms extend radially.

6. A hydraulic pump as claimed in claim 5 wherein movement of the flat spring valve is limited by means of an abutment arranged adjacent thereto.

* * * * *